United States Patent [19]

Roeder

[11] 4,329,916

[45] May 18, 1982

[54] PACKER NOSE ASSEMBLY

[76] Inventor: George K. Roeder, P.O. Box 4335, Odessa, Tex. 79760

[21] Appl. No.: 1,093

[22] Filed: Jan. 5, 1979

[51] Int. Cl.[3] ..... F16J 9/08

[52] U.S. Cl. ..... 92/240; 92/242; 166/191; 166/202; 277/212 C

[58] Field of Search ..... 92/240, 241, 242, 250, 92/251, 249, 244; 417/555 A; 277/212 C, 212 R; 166/202, 191, 121

[56] References Cited

U.S. PATENT DOCUMENTS

| | | | |
|---|---|---|---|
| 1,324,272 | 12/1919 | Ryan | 92/241 X |
| 2,080,736 | 5/1937 | Nixon et al. | 277/212 C |
| 2,377,039 | 5/1945 | Reilly | 92/242 |
| 2,585,706 | 2/1952 | Ware | 277/212 X |
| 3,010,518 | 11/1961 | Harmon | 277/212 X |
| 3,603,215 | 9/1971 | Leschisin | 92/240 X |
| 4,165,084 | 8/1974 | Kempf | 92/241 X |

*Primary Examiner*—Irwin C. Cohen

*Attorney, Agent, or Firm*—Marcus L. Bates

[57] ABSTRACT

A packer nose assembly for pumping downhole equipment of the free type into and out of a tubing string located within a borehole. The assembly includes a mandrel having a lower end portion attachable to the downhole equipment and an upper end portion terminating in the form of a fishing neck. One or more packers are slidably received in a telescoping manner upon the mandrel and fixed in spaced-apart relationship respective to one another by spaced sleeves which are likewise slidably received upon the mandrel. Each packer is cylindrical in form and includes a resilient cup member which is affixed to the mandrel by a mount member. A marginal end of the cup is in the form of a lip which circumferentially extends about the mandrel and is biased into sealed engagement with the tubing wall. A marginal end of the mount member is in the form of a skirt which protects the cup member from damage.

7 Claims, 5 Drawing Figures

PACKER NOSE ASSEMBLY

BACKGROUND OF THE INVENTION

It is often desirable to place various downhole equipment into a borehole and later on retrieve the equipment therefrom. For example, in a cased borehole having a production tubing extending downhole into proximity of a fluid-producing formation, it is often desirable to place a package of instruments or other downhole equipment in the production tubing by circulating fluid in a downward direction through the production tubing until the package arrives at its destination. Later, when it is desired to retrieve the package of instruments, reverse circulation is employed to circulate the package back uphole to the top of the production tubing.

Accordingly, it is desirable to have made available a packer nose assembly for pumping downhole equipment of the free type into and out of boreholes. It is further desirable that the packer nose assembly be of a design which reduces flow across a packer element thereof so that very little slippage of fluid occurs as the assembly is being circulated into or out of a borehole. A device of this type is especially useful in conjunction with downhole, hydraulically-actuated pumps. A packer nose assembly of the above described type is the subject of this invention. The following patents exemplify the prior art: U.S. Pat. Nos. 2,719,768; 2,802,535; 2,893,493; 3,525,401; 3,530,935; Great Britain Pat. No. 703,381; and Great Britain Pat. No. 917,863.

SUMMARY OF THE INVENTION

A packer nose assembly for pumping downhole equipment of the free type into and out of a tubing string located within a borehole. The assembly comprises a mandrel having a lower end portion which can be removably affixed to the downhole equipment. A fishing neck is located on the opposed, upper end portion thereof. A pair of spaced packer members are located intermediate of the opposed ends of the mandrel which sealingly engage the tubing wall in a slidable manner.

The packer members are cylindrical in form and include a resilient cup which is removably affixed to the mandrel by means of a mount member. One marginal end of the cup is removably affixed to the mount member, while the other marginal end of the cup circumferentially extends about the mandrel and away from the mount member to provide a lip. The lip sealingly engages the tubing wall, while the mount member sealingly supports the cup to the mandrel. The mount member also protects the cup from damage. The packer nose assembly is especially adapted for forming the upper end portion of a free-type, downhole, hydraulically-actuated pump assembly.

A primary object of this invention is to provide improvements in a packer nose assembly for downhole equipment of the free type.

Another object of the invention is to provide a packer nose assembly for a free-type, downhole, hydraulically-actuated pump assembly.

A further object of this invention is to disclose and provide a packer device for pumping downhole equipment into and out of a borehole.

A still further object of this invention is to provide a resilient packer member which is efficient in operation, rugged in design, and low in cost.

Still another object of this invention is the provision of a packer nose assembly having a cup which is free of wire and other metal objects which could come loose in the well, causing expensive fishing and pulling jobs.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
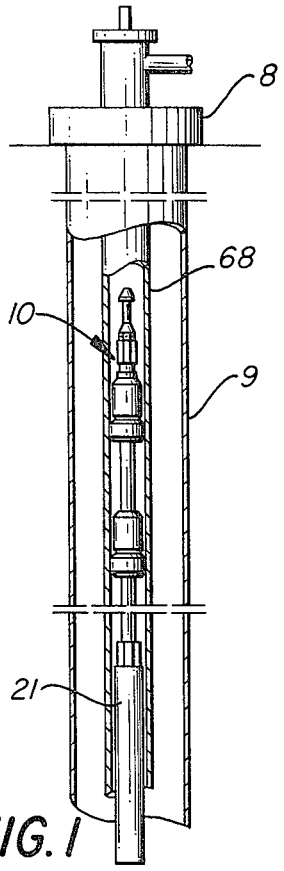
FIG. 1 is a vertical, part cross-sectional view of a borehole having disposed therein apparatus made in accordance with the present invention.

In FIG. 1 there is schematically disclosed a wellbore having a Christmas tree 8 and a casing 9 within which there is disposed a tubing string 68. A packer nose assembly 10, made in accordance with the present invention, is attached to the upper end of a downhole pump 21 of the free type so that the pump can be circulated into and out of the borehole.

Figure 2:
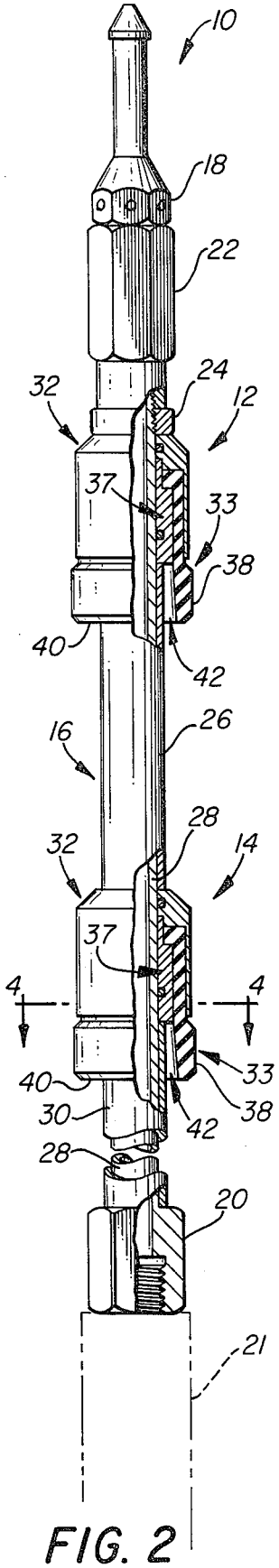
FIG. 2 is an enlarged, part cross-sectional view of the present invention.

As seen in FIG. 2, in conjunction with other figures of the drawings, the packer nose assembly includes spaced-apart upper and lower packer apparatus 12 and 14. The packer apparatus are axially aligned respective to one another and affixed to a mandrel 16. An apertured fishing neck 18 is attached to the upper end of the mandrel, while the lower marginal end of the mandrel is in the form of a box or female threaded sub 20 which is threadedly attached to a downhole, hydraulically-actuated pump 21 of the free type.

Sub 22 threadedly mates with the fishing neck and abuttingly engages a nut 24. Sleeve 26 abuttingly engages the adjacent ends of the spaced-apart packer apparatus and is slidably received externally of the hollow mandrel 28. Sleeve 30 abuttingly engages the box 20 and the lower end of packer 14.

Figure 3:
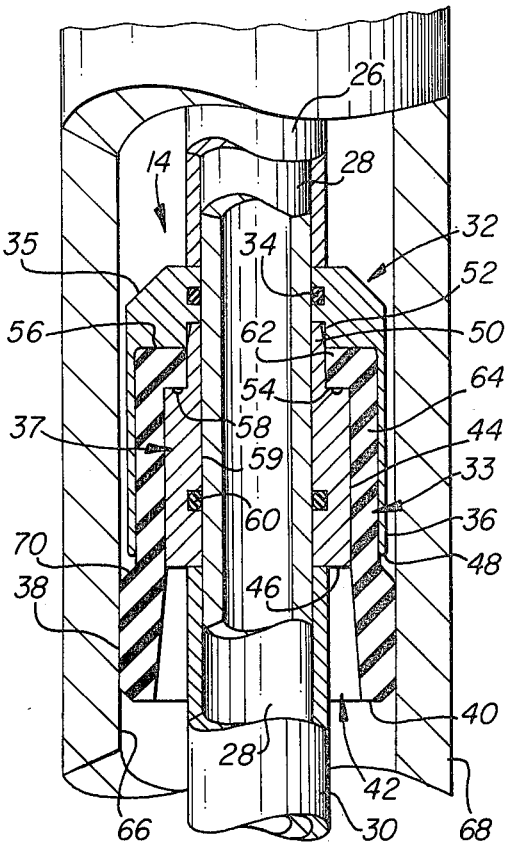
FIG. 3 is a further enlarged, fragmentary, cross-sectional representation of part of the apparatus seen in FIG. 1.
Figure 5:
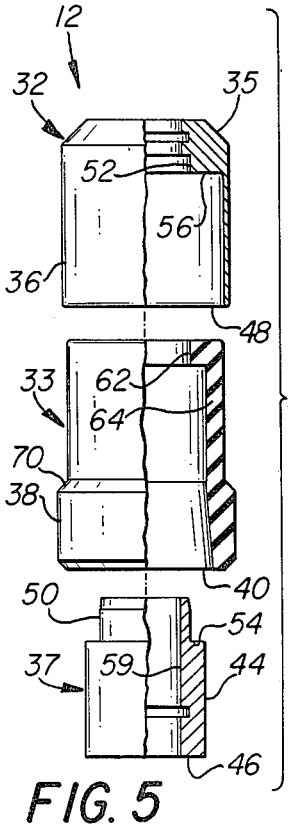
Figure 4:
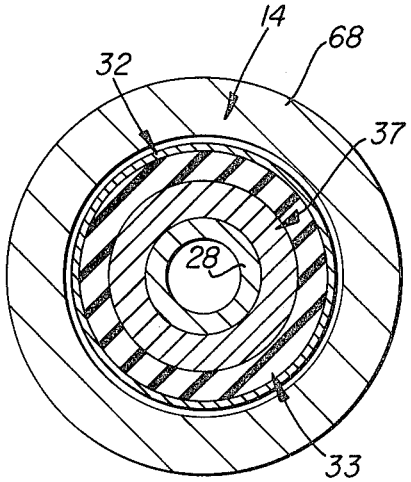
FIG. 4 is an enlarged, cross-sectional view taken along lines 4—4 of FIG. 2; and, FIG. 5 is an exploded view of the apparatus disclosed in FIG. 3.

As best seen in FIG. 3, in conjunction with other figures of the drawings, each packer apparatus includes a mount assembly 32 by which a resilient seal element or cup 33 is mounted to the mandrel in sealed relationship therewith. O-ring 34 is positioned within the central counterbore of the upper hub end 35 of the outer mount member. Skirt 36 is attached to the upper hub end and circumferentially extends about the upper marginal end of the cup in spaced relationship to an inner mount member 37 which forms part of the mount assembly.

Circumferentially extending lip 38 has a lower terminal end 40 spaced from the mandrel to form a downwardly opening annulus 42. Accordingly, the circumferentially extending outer wall 44 of the inner member and the circumferentially extending inner wall surface of the skirt member capture the upper marginal end of the cup therewithin, with the outer surface of the skirt protecting the upper end of the cup.

Lower terminal end 46 of the inner mount member terminates slightly below the lower terminal end 48 of the skirt. The upper end 50 of the inner member is reduced in diameter and is received within a counterbore 52 of the outer mount member such that spaced shoulders 54 and 56 result in a circumferentially extending cavity. Shoulder 54 is provided with a groove 58, while the inner wall surface 59 is provided with O-ring 60 set in the illustrated O-ring groove.

The upper end of the rubber cup is inwardly directed to form a flange at 62. The flange forms the upper marginal end of the constant diameter portion 64 of the cup.

The lip 38 of the rubber bears against the inside peripheral wall surface 66 of the tubing 68. The lip increases in thickness in a downward direction at 70 between edges 46 and 48 of the inner and outer mount members.

In operation, assuming the packer nose assembly 10 is attached to a downhole, hydraulically-actuated pump 21 of the free type, the apparatus is dropped into the tubing string in the usual manner and circulated downhole.

As the apparatus moves downhole, the circumferentially extending lip 38 sealingly engages the tubing wall 66 in a slidable manner. The trip to the bottom of the borehole is usually thousands of feet long; and accordingly, the outer surface of the lip bears against the inner surface of the tubing for a considerable length of time and is therefore subjected to a substantial amount of wear.

The lip 38 has an outside diameter slightly greater than the inside diameter of the tubing. Accordingly, the memory of the rubber causes the lip to always be biased into engagement with the inner peripheral wall surface of the tubing. As the lip encounters irregularities on the tubing wall, it is flexed inwardly and outwardly. As the lip flexes inwardly, the hinge point formed by edge portion 46 of the inner mount member is located in staggered relationship respective to the hinge point formed between edge portion 48 of the skirt and the rubber, thereby staggering the fatigue area on the inner and outer surfaces of the rubber. This provides two different hinge points which greatly elongate the life of the cup, as contrasted to a single hinge point which superimposes the flex areas and accelerates cup failure.

An important aspect of the present invention is the provision of a rubber having no reinforcing metal located therewithin. Accordingly, as the rubber reaches the end of its useful life, should it encounter an object and become ruptured, there are no metal pieces or wires to fall downhole into the borehole.

The flange 62 is tightly compressed between shoulders 56 and 54. Circumferential groove 58 deforms the lower surface of the cup flange sufficiently to form what appears to be one half of the O-ring and thus improves the seal therebetween.

The outer mount member provides a metal shield on the outer marginal end of the packer element and prevents the rubber cup from ballooning out of the mount member when unseating the pump. The outer mount member also provides a guide means as well as a protector for the upper marginal end of the rubber cup.

It is considered within the comprehension of this invention to invert one of the packers when operating in a well without an O-ring collar, or when using a pump which is too long to fit in a regular pump cavity. In this instance, the uphole pressure forces the lip of the cup out firmly against the tubing wall so that hydraulic fluid is forced into the ports of the fishing neck, through the hollow mandrel, and down to the hydraulically-actuated pump.

The rubber preferably is made of high temperature buna of a duro of 90 which is suitable for use up to 325° F. Regular buna is suitable for downhole temperatures up to 275° F.

I claim:

1. A packer nose assembly (10) for pumping downhole equipment of the free type into and out of a tubing string located in a borehole, comprising:

a mandrel (16) movable along an axis having a lower end portion (20) and an upper end portion (18); means forming a fishing neck (18) on said upper end portion; means (20) on said lower end portion of said mandrel by which said packer nose assembly can be affixed to downhole equipment;

a cylindrical packer apparatus (12 or 14) comprising a mount member (32 and 37) and a preformed resilient cup (33); said mount member includes an inner member (37) and an outer member (32), said outer member having an upper end portion (35) in the form of a hub which sealingly engages said mandrel therewithin, and a skirt extending from said hub and (36) spaced from and circumferentially extending about said inner member, said inner member having an axial bore (at 28) of a diameter to receive said mandrel therethrough, a marginal length of said inner member being reduced in diameter (at 50) and received within a recessed portion of said hub (at 52), thereby leaving a large diameter marginal length (44) of said said inner member concentrically arranged in spaced relationship respective to said skirt;

said hub having an axial bore; a first shoulder (56) formed on said hub at a location where the skirt joins the hub, a second shoulder (54) formed on said inner member between the small and large diameters thereof, said first and second shoulders being spaced from one another to form an upper annulus (at 62) which communicates with another annulus (at 64) which is formed between said skirt and said large diameter marginal length of said inner member, said another annulus being defined by overlying coaxial cylindrical surfaces formed on said skirt and said large diameter marginal length of said inner member;

said preformed resilient cup having an upper marginal length including coaxial cylindrical surfaces (at 64) received within said another annulus; the upper end of said cup terminates in an inwardly directed flange (62) which is received within said upper annulus, the length of said cylindrical cup surface and said another annulus cylindrical surface being substantially greater than the length of said flange;

said cup, inner member, and outer member being concentrically arranged respective to one another with the upper marginal length of the cup being tightly received within said another annulus, and with the flange being received in compressed relationship between the first and second shoulder;

a lower marginal length (38) of the cup extends downwardly and outwardly from the mount member for sealingly engaging a tubing wall.

2. The packer nose assembly of claim 1 wherein the lower marginal length of said cup is relatively shorter than the upper marginal length of said cup, said lower marginal end of said cup is increased in diameter and extends radially outwardly a greater distance as compared to the outer diameter of said skirt member, said lower marginal length of said cup is spaced from said mandrel to form an annular chamber therebetween so that when a pressure differential is applied across said packer, the cup is expanded radially outwardly.

3. The packer nose assembly of claim 2 wherein there are two cylindrical packer apparatus spaced from one another in axially aligned relationship along said mandrel; one cylindrical spacer received about the mandrel at a location between the two cylindrical packers, with the lowermost end of the inner member of one packer and the uppermost end of the hub of the other packer abuttingly engaging the opposed ends of the spacer;

and means forcing the hub member of said one packer towards the inner member of said other packer to compress the cups located within the mount member of each packer.

4. The packer nose assembly of claim 2 wherein the lowermost end of said inner member is terminated below the lowermost end of the skirt so that as the cup is flexed radially outwardly, the outer surface thereof engages the skirt at a different location compared to the contact area of the inner surface of the cup when the latter is flexed inwardly against the inner member.

5. In a downhole pump of the free type which can be circulated into and out of a tubing string located within a borehole, the combination with said pump of a packer nose assembly;

said packer nose assembly includes a hollow mandrel movable along the axis of said tubing string, means at the lower end of said mandrel by which the assembly is affixed to the upper end of the pump, means forming a fishing neck at the upper end of the assembly; two spaced cylindrical packer apparatus, including means by which said packers are received in mounted relationship on said mandrel such that fluid can flow into said fishing neck, through said mandrel, and into said pump while the packers sealingly engage a tubing wall;

each said packer apparatus includes a cylindrical preformed resilient cup and a mount member, said mount member includes an inner member and an outer member by which said cup is held in mounted relationship respective to said mandrel; said inner member is telescopingly received within said cup; said cup has one marginal end thereof telescopingly received within said outer member, with the other marginal end thereof extending downwardly from said inner and outer members, and radially extending outwardly from said mandrel to engage said tubing string, to form an annular cavity between said mandrel and the inside lower peripheral surface of the cup;

said outer member includes a hub having a central passageway which sealingly engages said mandrel; a skirt extending from said hub and about the one marginal end of said cup, said skirt and said central passageway having an upper shoulder formed therebetween, a counterbore concentrically arranged respective to said central passageway at a location between said upper shoulder and said axial passageway;

said inner member includes a small diameter and a large diameter circumferentially extending outer surface area, with a lower shoulder being formed therebetween; said small diameter outer surface area being received within said counterbore with said upper and lower shoulders being spaced apart in opposed relationship to form an upper annulus which communicates with a lower annular area formed between the skirt and inner member, said lower annular area being defined by overlying coaxial cylindrical surfaces formed on said skirt and the large diameter portion of said inner member;

said cup having an inwardly directed flange which is received within said upper annulus with the first and second shoulders engaging opposed surfaces of the flange, said cup further having coaxial cylindrical surfaces of said skirt and the large diameter portion of said inner member, the length of said cylindrical cup surfaces and said cylindrical surfaces of skirt and the large diameter portion of said inner member being substantially greater than the length of said flange;

and means forcing said first and second shoulders towards one another to compress the flange therebetween and between said inner and outer member.

6. The combination of claim 5 wherein the lower marginal end of said cup is increased in diameter and thickness, and extends radially outwardly a greater distance as compared to the outer diameter of said skirt, said lower marginal end of said cup is spaced from said mandrel to form said annular cavity therebetween, so that when a pressure differential is applied across said packer, the cup is expanded radially outwardly.

7. The combination of claim 6 wherein the lowermost end of said inner member is terminated below the lowermost end of the skirt so that as the cup is flexed radially outwardly, the outer surface thereof engages the skirt at a different location along the mandrel as compared to the contact area of the inner surface of the cup when the latter is flexed inwardly against the inner member.

* * * * *